US006086318A

United States Patent [19]

Bogendörfer

[11] Patent Number: 6,086,318

[45] Date of Patent: Jul. 11, 2000

[54] METHOD AND DEVICE FOR TILTING ROLLED SECTIONS, FOR EXAMPLE BILLETS, ABOUT THEIR LONGITUDINAL AXES

[75] Inventor: Hans Bogendörfer, Düsseldorf, Germany

[73] Assignee: SMS Schloemann-Siemag Aktiengesellschaft, Düsseldorf, Germany

[21] Appl. No.: 09/082,881

[22] Filed: May 21, 1998

[30] Foreign Application Priority Data

May 31, 1997 [DE] Germany ..... 197 22 879

[51] Int. Cl.[7] ..... B65G 47/24

[52] U.S. Cl. ..... 414/783; 198/413

[58] Field of Search ..... 414/783, 754, 414/764, 766; 198/413

[56] References Cited

U.S. PATENT DOCUMENTS

| | | | |
|---|---|---|---|
| 2,664,215 | 12/1953 | Bottenhorn | 198/413 |
| 3,044,636 | 7/1962 | Smith | 414/783 |
| 3,112,829 | 12/1963 | Modder | 414/783 |
| 3,401,805 | 9/1968 | Bucheit | 414/783 |
| 3,866,762 | 2/1975 | Paletzki | 414/783 |
| 4,368,815 | 1/1983 | Kvasnicka | 414/783 |
| 4,404,834 | 9/1983 | Tanaka | 198/413 |

FOREIGN PATENT DOCUMENTS

| | | |
|---|---|---|
| 1028960 | 4/1958 | Germany . |
| 1527714 | 1/1970 | Germany . |
| 2533287 | 2/1977 | Germany . |
| 2742439 | 3/1979 | Germany . |

*Primary Examiner*—Gregory A. Morse
*Attorney, Agent, or Firm*—Friedrich Kueffner

[57] ABSTRACT

A method of tilting rolled sections, for example billets, about their longitudinal axes into an on-edge position or diamond pass position. The method utilizes a device which includes a frame that is moveable transversely of a roller conveyor for transporting the billets, and a roller head with pivoting drive equipped with clamping rollers for clamping a billet and pivotable about an axis extending parallel to the longitudinal axis of the billet, wherein the roller head grasps the billet during the longitudinal conveyance thereof and tilts the billet by a predetermined angle before the billet enters a following station, and wherein the roller head lifts the billet guided between the clamping rollers during the tilting procedure above the conveying plane of the roller conveyor.

17 Claims, 4 Drawing Sheets x-x
y-y
135°
D

METHOD AND DEVICE FOR TILTING ROLLED SECTIONS, FOR EXAMPLE BILLETS, ABOUT THEIR LONGITUDINAL AXES

BACKGROUND OF THE INVENTION

1. Field of the Invention

The present invention relates to a method of tilting rolled sections, for example billets, about their longitudinal axes into an on-edge position or diamond pass position. The method utilizes a device which includes a frame that is moveable transversely of a roller conveyor for transporting the billets, and a roller head with pivoting drive equipped with clamping rollers for clamping a billet and pivotable about an axis extending parallel to the longitudinal axis of the billet, wherein the roller head grasps the billet during the longitudinal conveyance thereof and tilts the billet by a predetermined angle before the billet enters a following station.

The present invention also relates to the device for tilting rolled sections, particularly for carrying out the method according to the present invention.

2. Description of the Related Art

When processing billets into light sections or wire, it is frequently necessary to introduce a billet emerging from a furnace on a roller conveyor into the groove of the first stand of the light section or wire mill in the so-called diamond pass position. In order to make this possible, a device for tilting the billets is usually arranged between the furnace and the first stand, wherein the device can also be called a device for placing billets in an upright position.

A device of this type known in the art has, for example, two rollers which are rotatably mounted in a frame. One of the rollers is usually mounted so as to be stationary, while the other roller is adjustable. The frame can be pivoted together with the two rollers by means of a special drive in the plane of the two roller axes about an angle of 45°. Before a billet enters this device, the adjustable roller is lifted up from the stationary roller to such an extent that the billet can move unimpededly between the two rollers. As soon as the billet is located between the two rollers, the adjustable roller is once again lowered, so that the billet is guided between the rollers. By switching on the drive provided for the frame, the frame is now pivoted by an angle of 45° and the billet is positioned by the two rollers into the diamond pass position in which the billet can enter the first stand of the light section or wire mill.

DE-OS 25 33 287 describes a device for tilting billet-shaped rolling stock, wherein the device includes two positioning rollers arranged at a distance and parallel to each other, wherein one of the rollers is mounted so as to be stationary and the other roller is adjustable. When travelling through the rolls, the rolling stock is tilted by means of truncated cone-shaped rollers about an edge, wherein the entering billet presses the adjustable roller against the restoring force of a spring into a passage position.

This device has the disadvantage that the rolling stock is conveyed at rolling heat by the truncated cone-shaped rollers in the diamond pass position, so that the rolling stock is deformed at opposite edges and, thus, is damaged.

DE-AS 1 028 960 describes a gripping-type tilting device whose gripping jaws are mounted in a guide means so as to extend parallel to each other and are adjustable relative to the rolling stock, wherein the guide means is arranged so as to be pivotable about the edge axis in a carriage that is moveable transversely of the rolling direction. The guide means extends continuously on both sides of the edge axis, so that the gripping jaws are adjustable relative to each other by a conventional clamping device acting on the gripping jaws and are freely moveable together with clamping means over the entire guiding range. In the case of an asymmetrical position, the rolling stock is centered with the guide means, wherein impermissible bending stresses cannot be excluded.

Because the rolling stock is clamped from both sides, local deformations may occur which leave visible traces during further processing. Moreover, the device is comparatively complicated with a large number of individual elements and, therefore, is susceptible to trouble and requires maintenance when subjected to scale and other impurities during the rolling stock transportation. A tilting angle of more than 45° cannot be achieved with this device.

DE-OS 27 42 439 discloses another device for tilting billets, wherein the device includes pairs of gripping units, for example, roller pairs, which are adjustable relative to rolling stock surfaces and arranged preferably between the furnace and the first roll stand of a rolling train. The gripping units are arranged at an end of a pivoting lever whose pivot axis is located in the longitudinal axis of the rolling stock and whose at least two pivot points are connected through parallel linkages to two or more additional levers so as to be pivotable, wherein the pivot axes are arranged in a common plane with the longitudinal axis of the rolling stock, and wherein the parallel linkages extend parallel to this plane.

This device has the disadvantage that after tilting has been effected another positioning of the rolling stock into the roll stand must be carried out which requires a vertical adjustment and additional displacement units. The pivot levers provided in a parallelogram arrangement with, for example, eight points of articulation, result in a complicated construction; in addition, also in this device, tilting of a billet by more than 45° cannot be carried out.

Finally, DE OS 1 527 714 discloses a tilting device for rolling stock in which a mechanism couples the force of gravity with a clamping force which is supposed to prevent an impermissible opening of the clamping roller during tilting. This has the result that the clamping force is increased in the case of heavy rolling stock which, in turn, may lead to high surface pressures and local deformations of the rolling stock.

SUMMARY OF THE INVENTION

Therefore, it is the primary object of the present invention to significantly improve the method and device of the above-described type and to tilt the rolling stock about a fixed point of its profile in order to avoid the requirement of once again having to position or move the rolling stock in the rolling train. Moreover, the rolling stock is to be unilaterally clamped against a fixed stop with a defined force in order to avoid local deformations or bending of the rolling stock. Finally, the construction of the tilting device required for this purpose should be particularly simple and, therefore, resistant to wear and, although being of compact construction, the device should make the use of additional roll fittings in the roll stand unnecessary. Furthermore, it should be possible to carry out tilting angles of up to at least 135°.

In accordance with the present invention, the roller head lifts the billet guided between the clamping rollers during the tilting procedure above the conveying plane of the roller conveyor.

The method according to the present invention makes it possible to achieve a tilting angle of up to 135° when carrying out tilting of more than 90°; moreover, damage or deformation or bending of the rolling stock are prevented.

In accordance with an advantageous feature of the method according to the present invention, at least one of the clamping rollers is driven for rotation by means of a motor, so that the conveying movement of the billet on the roller conveyor is assisted; this is made possible by directly flanging a hydraulic motor, for example, to the upper clamping roller.

In this connection, the method provides that the roller head is pivotable from its basic position by at least 135° and preferably about a pivot point which coincides with an edge of the billet profile.

In accordance with an advantageous feature, the operational sequence is carried out automatically with the use of a control unit.

In a device for tilting rolled sections, for example, billets, about their longitudinal axes, including a frame with means for moving the frame transversely of a roller conveyor which transports the billets, wherein the device includes a roller head equipped with clamping rollers for clamping a billet and with a pivoting drive, wherein the roller head is pivotable about a pivot axis extending parallel to the longitudinal axis of the billet, the present invention provides that

- a hydraulic unit is provided for tensioning and untensioning the moveable clamping roller, wherein the hydraulic unit is mounted on the roller head;
- the roller head is mounted on a swing lever which can be raised and lowered by means of a hydraulic unit and whose vertical position is changeable relative to the conveying plane of the roller conveyor; and
- the roller head is guided in guide rollers in a ring guide means and includes a pivot drive formed by hydraulic units.

A further development of the device provides that the pivoting drive is formed by two hydraulic units which are connectible by means of a joint to form a kinematic unit, wherein one of the hydraulic units is immovably mounted on the frame and is guided with its piston rod head constructed as a joint in a linear guide means transversely of the pivot axis of the roller head, while the other hydraulic unit is connected in an articulated manner to the joint, on the one hand, and to the roller head, on the other hand, and is moveable between the two points of articulation.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
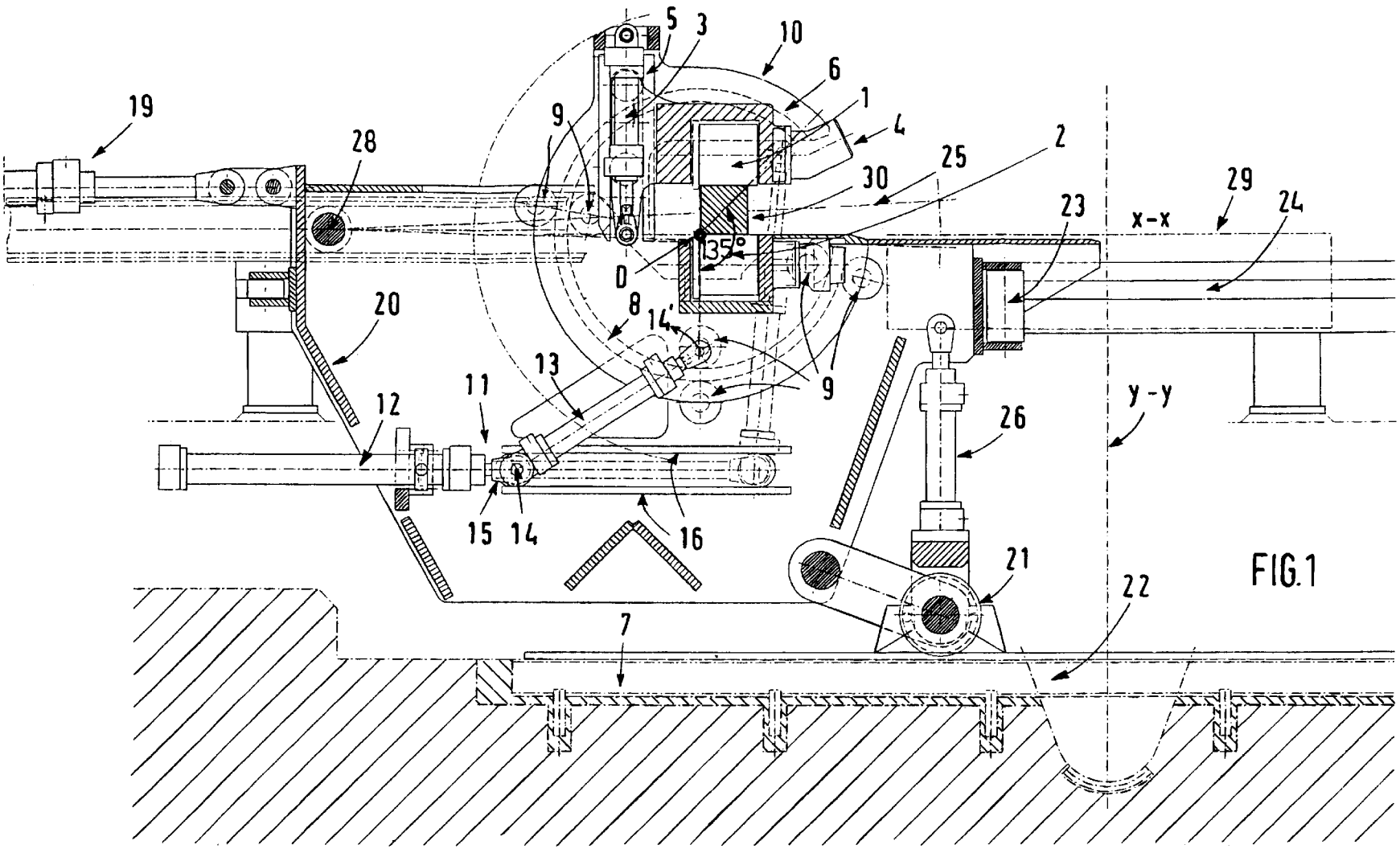
FIG. 1 is a side view, partially in section, of a device for tilting square billets about their longitudinal axes.

FIG. 1 of the drawing shows an overview of the entire device according to the present invention for tilting a billet 30 about its longitudinal axis. The device includes a frame 20 with a hydraulic unit 19 for displacing the frame 20 transversely of a roller conveyor 29 which transports the billet 30. The frame 20 has a roller head 10 equipped with clamping rollers 1, 2 for clamping a billet 30 and a pivoting drive 11. The roller head 10 is pivotable preferably by 135° about an axis extending parallel to the longitudinal axis of the billet 30. The roller head 10 has a stationary clamping roller 2 and a clamping roller 1 which can be moved in the manner of tongs for clamping the billet 30.

A particularly compact and uncomplicated construction of the roller head 10 is achieved by arranging a hydraulic unit 3 on the roller head 10 for tensioning and untensioning the moveable clamping roller 1, wherein, together with a guide means in the roller head 10 provided for the hydraulic unit 3, the billet 30 can be grasped and clamped with adjustable clamping force.

In accordance with a significant feature of the present invention, the roller head 10 is arranged on a swing lever 25 which can be raised and lowered by means of a hydraulic unit 26 and whose vertical position is changeable relative to the conveying plane x—x of the roller conveyor 29. This swing lever 25 is pivotably mounted in the horizontal joint axis 28 at the opposite end of the hydraulic unit 26.

In accordance with another feature, at least the clamping roller 1 which is moveable in the manner of tongs is constructed so as to be rotatably driven by a hydraulic motor 4.

In accordance with an important further development of the device according to the present invention, the roller head 10 is guided in guide rollers 9 in a ring guide means 8 and is provided with a pivoting drive 11 formed by hydraulic units 12, 13. Such a drive is uncomplicated, does not have elements which are susceptible to wear, can be manufactured with commercially available hydraulic units 12, 13, and is distinguished by a very simple and maintenance-free construction.

The pivoting drive 11 is composed of two hydraulic units 12, 13 which are connectable to form a kinematic unit through a joint 14, wherein the hydraulic unit 12 is immovably mounted on the frame 20 and is guided with its piston rod head 15 constructed as the joint 14 in a linear guide means 16 transversely of the pivot axis of the roller head 10, while the other hydraulic unit 13 is hinged, on the one hand, to the joint 14 and, on the other hand, to the roller head 10 and is guided so as to be moveable between these two hinge points 14, 14'. FIG. 1 shows in dash-dot lines the position of the hydraulic units 12, 13 when the roller head 10 carries out a pivoting movement about the pivot point D by 135°.

FIG. 1 of the drawing further shows that the frame 20 is horizontally moveable with travel rollers 21 along a rail 22 on the foundation 7 and is guided with guide rollers 23 along a guide rail 24 which extends at a vertical distance and parallel to the rail 22, wherein a hydraulic unit 19 is provided as the drive for the frame 20.

The uncomplicated construction of the roller head 10 makes it possible in an advantageous manner that the clamping rollers 1, 2 are exchangeable and can be replaced, for example, by profiled rollers.

A very compact and uncomplicated construction of the roller head further results from the fact that the roller head is provided with a ring-shaped guide web 8 with which it is guided so as to be pivotable about 135° in a connecting member 6 which is connected to the swing lever 25 and is provided with guide rollers 9. This configuration additionally results in an extremely simple assembly and disassembly of the roller head, for example, in the event that the clamping rollers 1, 2 have to be exchanged and replaced by profiled rollers.

Figure 2:
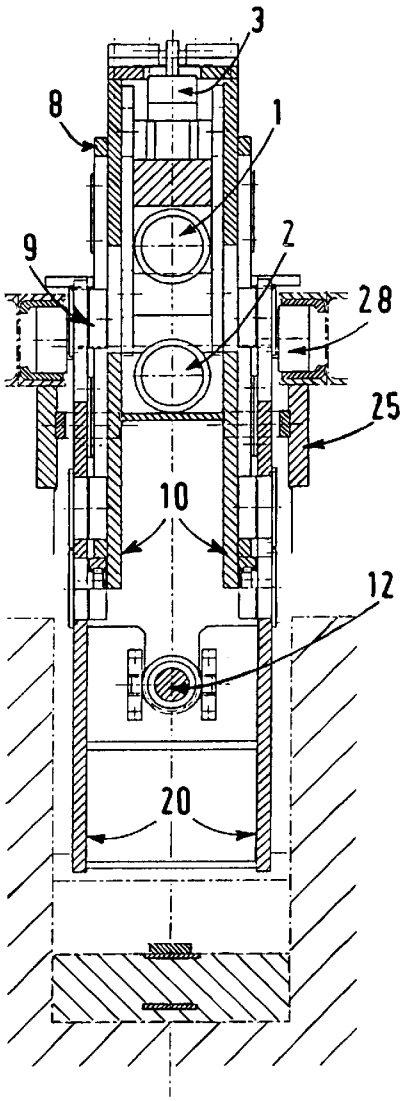
FIG. 2 is a front view, partially in section, of the tilting device according to FIG. 1.

FIG. 2 shows the configuration of the device according to the present invention in a front view and shows particularly impressively the compact arrangement of the individual elements and the interaction thereof. Since the same elements are provided with the same reference numbers, a description thereof does not have to be repeated.

Figure 3:
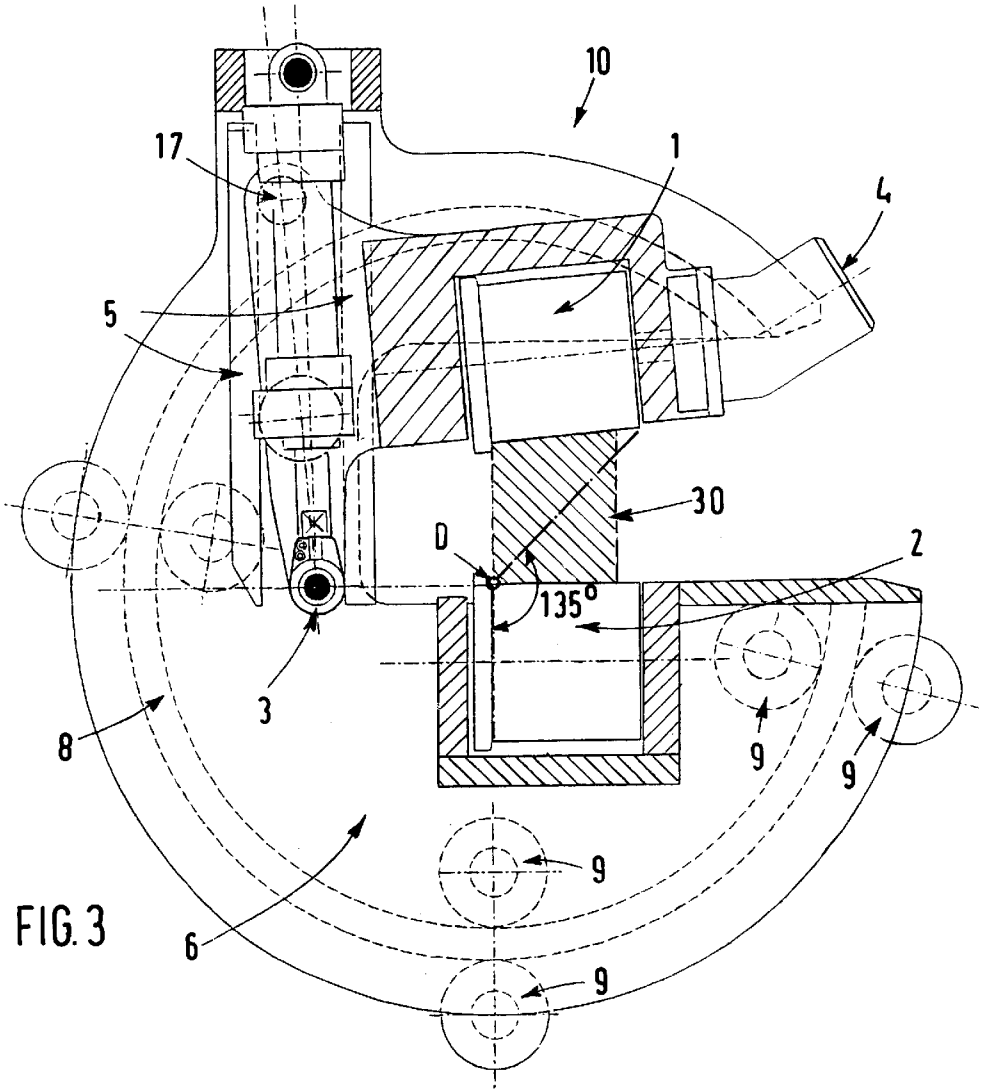
FIG. 3 is a side view, partially in section and on a larger scale, of a roller head.
Figure 4:
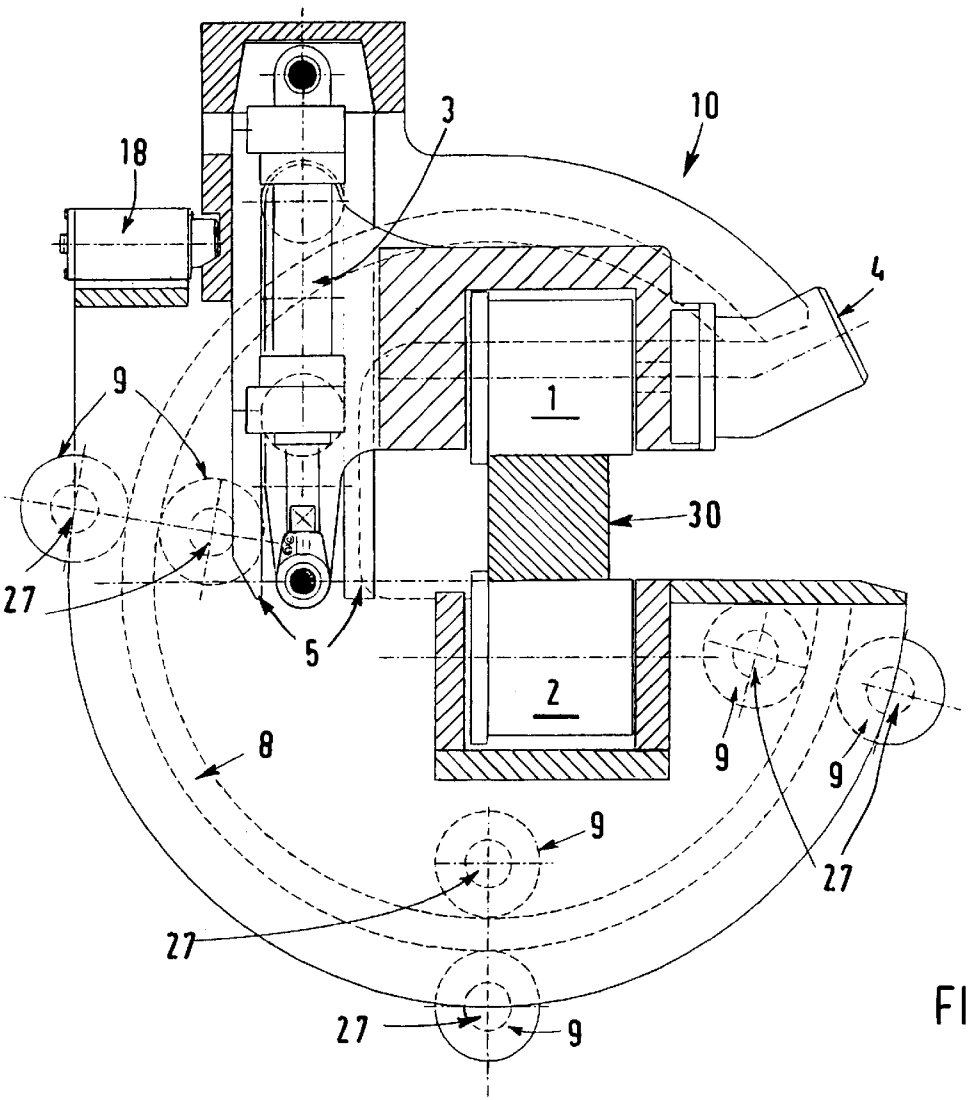
FIG. 4 is a side view, similar to FIG. 3, showing a different embodiment of the roller head.

FIGS. 3 and 4 each show a roller head 10 on a larger scale. The roller head 10 has a ring-shaped guide web 8 with which it is guided so as to be pivotable by 135° in a connecting member 6 which is connected to the swing lever 25 and supports guide rollers 9. This construction is especially uncomplicated and compact. The construction is further distinguished by the fact that all individual components can be easily assembled and disassembled, so that, in the case of an inspection or maintenance work, the necessary operations can be carried out with a minimum of labor and time and with very low costs.

In accordance with a significant further development of the present invention, as shown in FIG. 3, the upper clamping roller 1 is constructed as a closed structural group as a functional unit with the drive motor 4 and the hydraulic tensioning unit 3 including the guide means 5 therefor. This closed structural unit is hinged with a limited pivoting range at the roller head 10 by means of a pivot axis 17. This makes it possible that this structural unit assumes the inclined position shown in FIG. 3 which serves, for example, for a problem-free clamping of an asymmetrical profile of a billet 30. FIG. 3 additionally once again clearly shows the possibility that the billet 30 can be tilted about the edge point D by a 135°.

FIG. 4 shows an embodiment of the roller head 10 in which a locking element 18 can be arranged between the roller head 10 and the connecting member 6 supporting the roller head 10. This configuration makes it possible that, for example, when the billet 30 applies a force, the roller head with its pivot guide 8 is not unintentionally pivoted in the guide rollers 9. FIG. 4 further shows that the guide rollers 9 with the connecting member 6 can be easily assembled and disassembled through plug-type axles 27.

Figure 5:
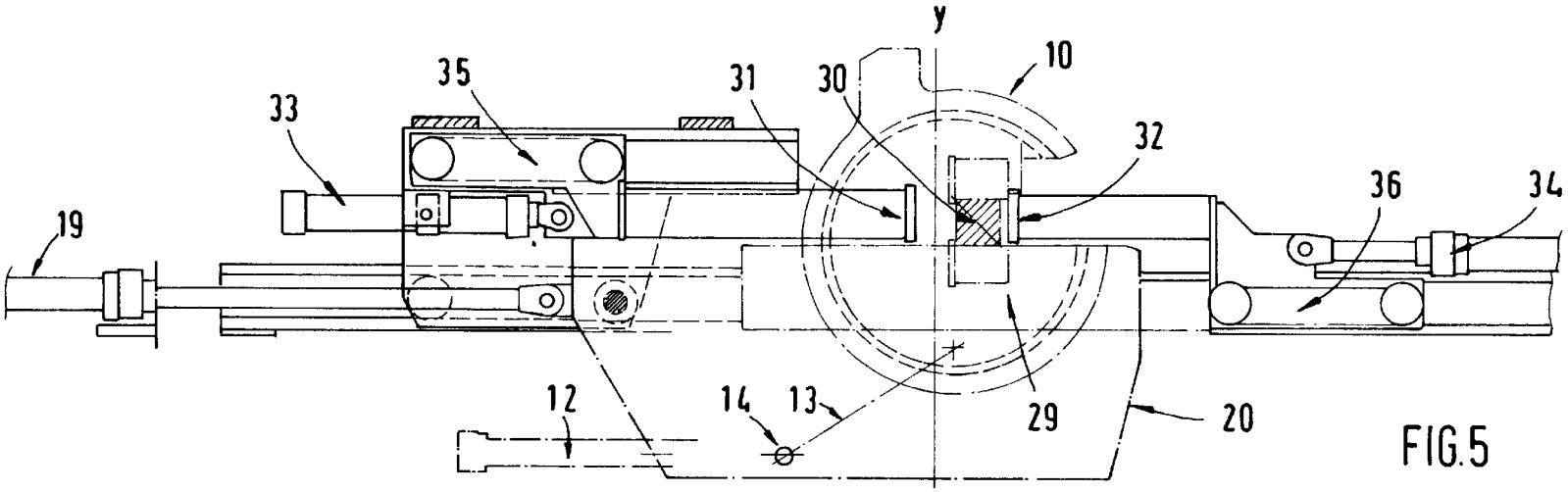
FIG. 5 is a side view of a tilting device with centering and displacement units mounted on both sides of the roller head.
Figure 6:
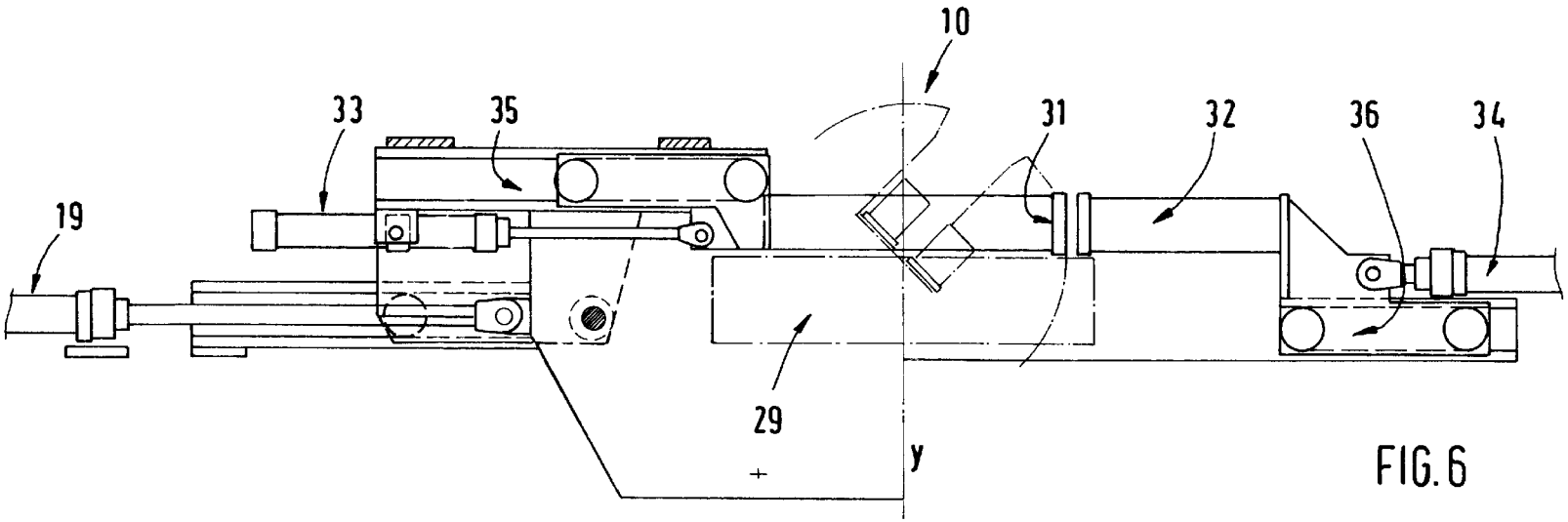
FIG. 6 is a side view showing the centering and displacement units of FIG. 5 In a different position relative to the roller conveyor.

FIGS. 5 and 6 of the drawing show that the roller head 10 is provided in an approximately radial position relative to its pivot axis and laterally offset relative to the roller head 10 with two slide members 32, 32 which can driven by hydraulic units 33, 34, wherein the slide members 31, 32 assist in the operation of the roller head 10 when the billet 30 is moved in and moved out. The dash-dot line y—y corresponds to the center plane of the roller conveyor 29.

When the roller head 10 or the tilting device with the roller head 10 is moved against a billet 30 in accordance with the illustration of FIG. 5, the slide member 32 forms as a centering device a stop for the billet 30 which on the other side is held by the slide member 31 in a predetermined position limit. As illustrated in FIG. 6, the centering and displacement elements 31, 32 can be used for correcting the direction of a billet without gripping the edges of the billet. The slide elements 31, 32 are horizontally moveable in guide members 35, 36.

When compared to the prior art, the tilting device according to the present invention provides the following advantages:

- compact flat structural form, so that the investment costs are reduced and a small foundation is sufficient, and the conveying movement of the roller conveyor is supported, particularly in the case of tilting the billet into the diamond pass position;
- significantly simplified construction and conduction of media, particularly by hydraulic actuation of all functional elements, so that the operations are free of wear even under difficult operating conditions;
- the functional groups can be easily disassembled, for example, by means of plug-type travel rollers or support and guide rollers;
- releasable clamping connection of the roller head for using different clamping rollers, for example, profiled rollers;
- use of a roller head which is constructed specially with a unitary structural group and suitable for different travel roller diameters, so that an adjustment of a roller to asymmetrical profiles becomes possible;
- capability of automating the sequence of movement during the tilting procedure by an angle of up to 135°; and
- a stationary pivot point on the upper edge of the roller conveyor roller.

While specific embodiments of the invention have been shown and described in detail to illustrate the inventive principles, it will be understood that the invention may be embodied otherwise without departing from such principles.

I claim:

1. A method tilting a rolled section about a longitudinal axis thereof, the method comprising using a device including a frame mounted so as to be moveable transversely of a roller conveyor conveying the rolled section, the roller conveyor having a conveying plane, and a roller head equipped with clamping rollers for clamping the rolled section, and a pivot drive for pivoting the roller head about an axis extending parallel to the longitudinal axis of the rolled section, wherein the rolled section is grasped during the longitudinal conveyance thereof and is tilted by a predetermined angle before entering a subsequent station, further comprising lifting the rolled section guided between the clamping rollers of the roller head during the tilting procedure above the conveying plane of the roller conveyor by means of a swing lever acting on the roller head.

2. The method according to claim 1, comprising driving at least one of the clamping rollers for rotation by means of a motor, for assisting the conveying movement of the rolled section on the roller conveyor.

3. The method according to claim 1, comprising pivoting the roller head from a basic position thereof by at least 135°.

4. The method according to claim 1, comprising pivoting the roller head about a pivot point which coincides with an edge of the rolled section.

5. The method according to claim 1, comprising using a control unit for automatically carrying out the method.

6. A device for tilting a rolled section about a longitudinal axis thereof, the device comprising a frame including means for displacing the frame transversely of a roller conveyor for conveying the rolled section, the frame comprising a roller head equipped with first and second clamping rollers for clamping the rolled section and with a pivoting drive for pivoting the roller head about an axis extending parallel to the longitudinal axis of the rolled section, further comprising a first hydraulic unit for tensioning and untensioning the first clamping roller, wherein the first hydraulic unit is mounted on the roller head, wherein the roller head is mounted on a swing lever raisable and lowerable by means of a second hydraulic unit, wherein the swing lever has a vertical position adjustable relative to the conveying plane of the roller conveyor, further comprising a ring guide means with guide rollers for guiding the roller head.

7. The device according to claim 6, wherein the third and fourth hydraulic units of the pivot drive are connectable through a joint to form a kinematic unit, wherein the third hydraulic unit is immovably mounted on the frame, and the third hydraulic unit has a piston rod head forming the joint and guided in a linear guide means transversely of the pivot axis of the roller head, and the fourth hydraulic unit is hinged to the joint and to the roller head in hinge points and is movably guided between the two hinge points.

8. The device according to claim 6, wherein the frame comprises travel rollers for horizontally moving the frame along a rail, wherein the frame comprises guide rollers for guiding the frame along a guide rail extending at a vertical distance from and parallel to the rail, and wherein the frame comprises a fifth hydraulic unit for driving the frame.

9. The device according to claim 6, wherein at least the first clamping roller is moveable in the manner of tongs and is driveable for rotation by a hydraulic motor.

10. The device according to claim 6, wherein the clamping roller of the roller head are mounted so as to be replaceable.

11. The device according to claim 6, wherein the roller head comprises a ring-shaped guide web, wherein the roller head with the guide web is guided so as to be pivotable about at least 135° relative to the vertical axis in a connecting member connected to the spring lever and provided with guide rollers.

12. The device according to claim 6, wherein the upper clamping roller and a drive motor thereof and the first hydraulic unit including guide means thereof form a closed structural group as a functional unit hinged with a limitable pivoting range on the roller head by a pivot axle.

13. The device according to claim 11, comprising a locking element between the roller head and the connecting member supporting the roller head.

14. The device according to claim 11, comprising plug-type axles for connecting the guide rollers to the connecting member, whereby the guide rollers can be quickly assembled and disassembled.

15. The device according to claim 6, wherein the roller head comprises slide members arranged approximately in radial position relative to the pivot axis of the roller head and laterally offset relative to the roller head, and sixth and seventh hydraulic units for driving the slide members, wherein the slide members are configured to assist in the operation of the roller head when a rolled section is moved in and moved out.

16. The device according to claim 6, wherein the roller head comprises slide members arranged approximately in radial position relative to the pivot axis of the roller head and laterally offset relative to the roller head, and sixth and seventh hydraulic units for driving the slide members, wherein the slide members operate as slide means when the device is not in a position of operation.

17. The device according to claim 6, wherein the pivoting drive is comprised of a third hydraulic unit and a fourth hydraulic unit connected to each other through a joint, wherein the third hydraulic unit is immovably mounted on the frame and is guided in a linear guide means transversely of the pivot axis of the roller head, and wherein the fourth hydraulic unit is connected to the roller head in a hinge point, and wherein the fourth hydraulic unit is guided so as to be movable between the joint and the hinge point.

* * * * *